US005147615A

United States Patent [19]

Bird et al.

[11] Patent Number: 5,147,615

[45] Date of Patent: Sep. 15, 1992

[54] METHOD OF DISPENSING AND DISPENSER THEREFOR

[75] Inventors: K. J. H. Bird, Beeston; G. W. Crossdale, Swanwick, both of England; J. W. Livingston, Santa Cruz, Calif.

[73] Assignee: Diversey Corporation, Mississauga, Canada

[21] Appl. No.: 221,890

[22] Filed: Jul. 20, 1988

[30] Foreign Application Priority Data

Jul. 23, 1987 [GB] United Kingdom ..... 8717407

[51] Int. Cl.[5] ..... B01F 3/08

[52] U.S. Cl. ..... 422/261; 134/6; 134/7; 134/93; 134/198; 222/181; 222/185; 422/263; 422/264; 422/266; 422/267; 422/276; 422/277

[58] Field of Search ..... 422/261, 263, 264, 266, 422/267, 276, 277; 127/268; 134/67, 93, 198; 222/181, 185

[56] References Cited

U.S. PATENT DOCUMENTS

| | | | |
|---|---|---|---|
| 1,510,062 | 9/1924 | Kenney | 422/266 |
| 1,910,235 | 5/1933 | Burkett | 422/266 |
| 2,387,945 | 10/1945 | McDow | 422/266 |
| 2,601,672 | 6/1950 | Gatchet | 422/266 |
| 2,604,386 | 7/1950 | Arvant . | |
| 3,416,897 | 12/1968 | Long et al. | 422/266 |
| 4,250,911 | 2/1981 | Kratz | 422/264 |
| 4,426,362 | 1/1984 | Copeland et al. | 422/266 |
| 4,571,327 | 2/1986 | Larson et al. | 422/266 |
| 4,666,682 | 5/1987 | Mayer et al. | 422/266 |
| 4,759,907 | 7/1988 | Kandics et al. | 422/264 |

*Primary Examiner*—Robert J. Warden
*Assistant Examiner*—Timothy M. McMahon
*Attorney, Agent, or Firm*—Weintraub, DuRoss & Brady

[57] ABSTRACT

Method and apparatus for dispensing detergent from within a container comprises directing a water spray transversely of the container vertical orientation to dissolve and remove detergent in solution from the container. The transverse direction of water spray greatly improves detergent dispensing performance and minimize clogging of the system during down times.

2 Claims, 3 Drawing Sheets

METHOD OF DISPENSING AND DISPENSER THEREFOR

The present invention relates to a method of dispensing and to a dispenser, in particular for dispensing non-liquid detergents in processes such as machine dishwashing, manual washing of dishes and pans, in commercial kitchens, general cleaning activities, and in laundries. By the term "detergents" is meant any chemical product having a cleaning, drying and/or disinfecting property. The invention also relates to a container for detergent, for use in the dispenser.

Conventional dispensers for detergents for dishwashers comprise a container for the detergent into which a nozzle sprays water in a generally vertical direction. The nozzle is typically controlled by a valve connected in an electrical circuit which includes the washing vessel itself. When the concentration of the cleaning agent in the washing vessel falls below a given amount, the valve opens and water is sprayed. When the concentration reaches a sufficiently high level, the valve closes and spraying is stopped.

The container may either be a hopper which is refilled as necessary and in which the nozzle is permanently fitted, or may be a cartridge which, when empty, is disposed of and replaced by another full cartridge. In this case, the nozzle is mounted beneath the opening of the cartridge.

In both cases, the nozzle sprays upwardly and into the detergent which is supported above the nozzle by a coarse mesh.

These two conventional systems have been used very widely throughout the world for the past ten years or more. Between them, they account for the great majority of dispensing systems currently in use on industrial washing machines, for example for use in restaurants.

An object of the present invention is to provide an improved method of dispensing together with an improved dispenser and container to be used therewith.

Accordingly, the invention provides a method of dispensing detergent wherein water is discharged in a direction substantially transverse to the vertical and is injected either directly into a container of the detergent or upwardly into a container of the detergent via a nozzle integral with said container.

The invention also provides a dispenser for detergents comprising a support for a container of the detergent and means to discharge in a direction substantially transverse to the vertical.

A container for use with this dispenser comprises at least one lateral aperture in that portion of the container which, in use, is at the bottom. Alternatively, the container includes a nozzle device which injects water upwardly.

The method and dispenser of the invention have several advantages.

Where the detergent is in a powder, granular or pellet form, as the water is injected laterally into the detergent rather than vertically, the detergent is wet to a lesser extent. When the dispenser is not in use, any wet powder or granular material tends to solidify and prevent the dry detergent from being dispensed into the dishwasher. Accordingly, as there is less wetting in the invention, blocking is less of a problem.

Further, as there is less wetting, any chlorine based agents in the detergent are degraded to a lesser extent so the chlorine activity in the detergent is maintained.

Another advantage is that, with substantially horizontal injection of water, no nozzle is required on the dispenser. In systems using a nozzle, that nozzle often tends to block up, particularly in hard water areas. Further, where the nozzle is in a vertical orientation, parts of the detergent may fall on the nozzle and block it up.

Further, using a horizontal injection of water, much lower pressures can be tolerated than where a vertical nozzle is used. For example, the present invention will work down to pressures as low as 0.2 or 0.3 bar, at which pressure a nozzle would not be able to spray water with sufficient force to wash the detergent into the washing machine.

Still further, a horizontal jet of water requires no mechanism to shut it off when the container of detergent is removed and replaced. The conventional vertical sprays must be blocked as they could be dangerous to the user.

In a preferred embodiment of the invention, where the container holds detergent in a powder, granular or pellet form, the head portion of that container comprises a deflector, at least on the inner side part of the head portion which is opposite to the aperture through which the water is injected. When the washing machine is shut down, for example at weekends, there will be some blocking effect due to the detergent having been wetted. When the dispenser is turned on again, water coming in horizontally will clear away the blockage in between the aperture and the deflector, and when the water hits the deflector it will be deflected upwards and inwards to clear away what blockage there is there.

Where a solid detergent is used, the head portion of the container will comprise a nozzle means which can direct the water upwards onto the solid detergent. However, even in this case, the dispenser itself does not comprise a nozzle which could block up; on the contrary, the nozzle means is in the container and so will be replaced every time the container is replaced.

BRIEF DESCRIPTION OF THE DRAWINGS

Embodiments of the present invention are described below, by example only, with reference to the accompanying drawings, wherein.

Figure 1:
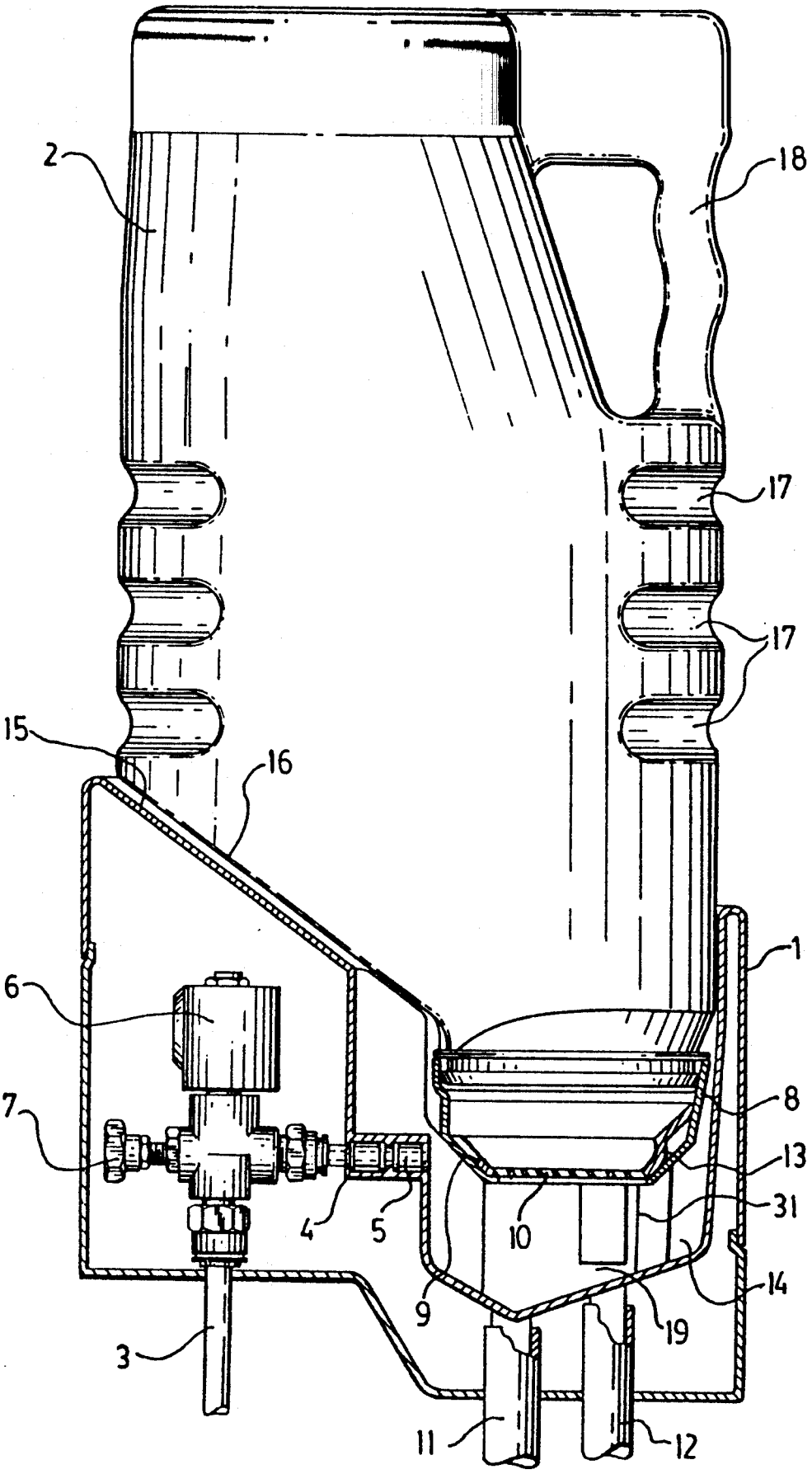
FIG. 1 is a lateral, partly sectional view of a dispenser on which a container of detergent is mounted; the detergent being in a powder, granular or pellet form.

The dispenser shown in FIG. 1 comprises a support 1 on which is mounted a container 2 of the detergent. The dispenser comprises a water inlet 3 and means 4 to inject water substantially horizontally into the container 2.

The means to inject the water comprises a jet tube 5 which passes through the wall of the support 1. Between the jet tube 5 and the water inlet 3 is fitted, in this particular embodiment, a solenoid. The solenoid valve 6 controls the supply of water to the jet tube so that detergent is dispensed only when required. In an alternative embodiment (not illustrated) the solenoid valve and electrical circuit could be omitted and the system could simply make use of the water power that is available at certain times in the washing cycle. The force of the water jet being injected via the jet tube 5 is controlled by an adjusting screw 7, discussed below.

On the support 1, and above the dispenser, is mounted a container 2. When mounted on the support 1, the head portion 8 of the container forms the base of the container. An aperture 9 in the side of the base 8 allows the water to pass across the base of the container.

The detergent in granular, powder or pellet form falls by gravity to the base of the container 2 and, when the valve allows water to be injected into the container, the detergent is washed, partly dissolved, by the water through a mesh 10 at the bottom of the head portion 8, and into an outlet 11 leading to the washing machine (not shown).

Figure 3:
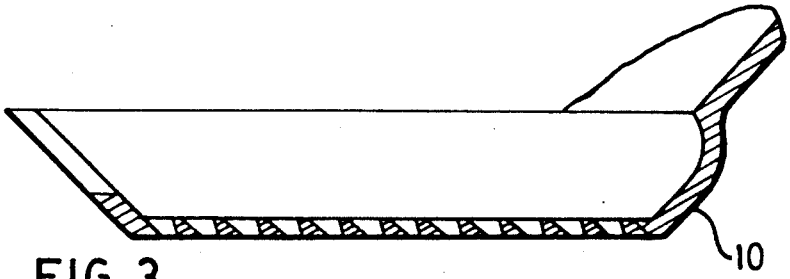
FIG. 3 is a sectional view of a preferred form of mesh to be used in the dispenser of FIGS. 1 and 2.

For granular feeding, the preferred embodiment of the mesh 10 is a louvre, as seen in FIG. 3, with the upper leading edges orientated towards the jet or jets. The granulometry of the detergent product is carefully controlled so that in the dry state the granulated product rests on the louvre and will not flow through it under its own weight. When water flows from the jet or jets the passage of water through the louvres entrains the granulated products and this resulting mixture is transported through the louvres into the outlet 11. In typical applications the average particle size could be 500 microns and the aperture between louvres 1.5 mm.

Water is intermittently injected into the container, controlled by the valve 6, until the detergent is all used up. When this happens, a new container full of detergent must be mounted onto the dispenser. However, at this point, the valve may be allowing water to be injected from the jet tube 5. In conventional systems, the water would be sprayed upwardly which is very dangerous as the water can be either very hot or can contain dangerous chemicals, or both. Conventional devices need to include some mechanism to prevent the spray of water injuring users.

However, with the present invention, as the water passes horizontally in the dispenser, no dangerous jet of water can spray out onto the user.

If the washing machine is shut down, for example at a week end, it is inevitable that some of the detergent not yet washed into the machine has been wetted to a certain extent. This detergent will be at the base of the container. With the conventional systems where a vertical jet of water is used, the depth of the wetted detergent is relatively great. This wetted portion of detergent tends to harden while the dispenser is not is used and so when the dispenser is next used, detergent is not dispensed efficiently.

In the described embodiment, when the dispenser is started up again, the horizontal jet will wash away hardened material at the very base of the container. Further, when the material at the very base has been washed away, the horizontal jet of water will reach a deflector 13 on the opposite side to the head portion of the container from the aperture 9. The deflector 13 deflects water in a generally upward direction. The deflector 13 is also shaped to spread out the jet of water into a sheet so that the water covers the entire base of the container. This sheet of water soon cuts through any hardened detergent at the base of the container. When the hardened detergent is cleared away, the dry detergent can fall as before and the dispenser then works normally again. It should be emphasized that this switch from the clearing away operation to the normal operation occurs automatically in the described embodiment.

Figure 4:
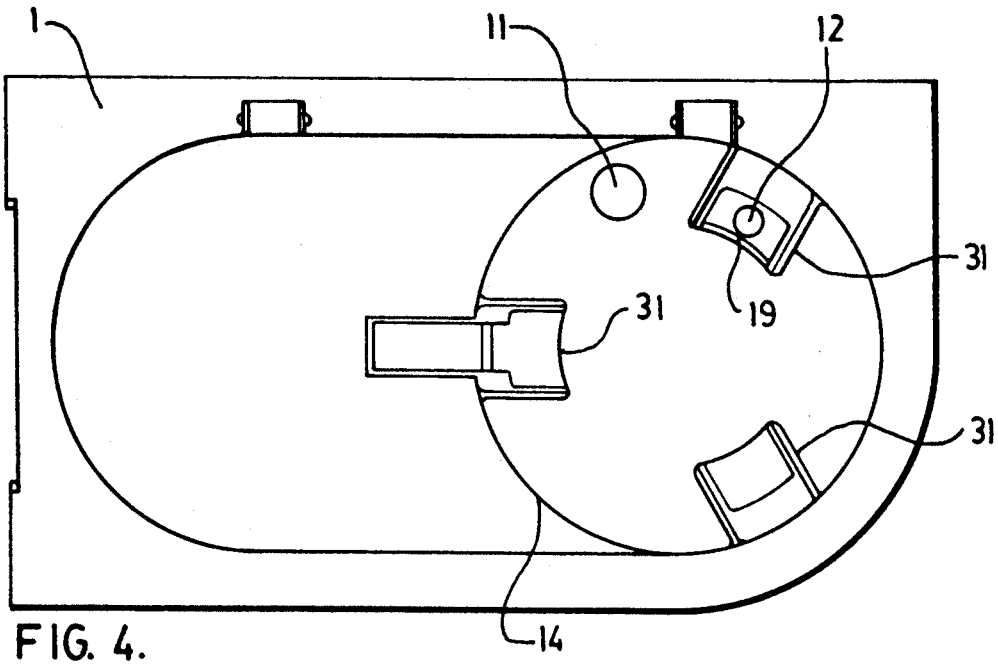
FIG. 4 is a plan view of the support shown in FIG. 1.

The dispenser as illustrated is preferably an integral wall mounted unit in which is housed the jet tube 5, the valve 6 and the adjusting screw 7. As most clearly seen in FIG. 4, the support 1 comprises a generally circular recess 14 into which the correspondingly shaped head of the container fits, resting on three seats 31. An overflow device 12 is situated in the recess 14 to prevent contamination of the water supply should outlet 11 become blocked. The size and position of the overflow are such that with the outlet 11 completely blocked and the solenoid valve 6 open continuously an air gap of at least 40 mm is maintained between the bottom of the jet tube 5 and the water surface. The overflow may also be protected by a weir 19 to prevent it from becoming blocked.

The dispenser also has an inclined portion 15 supporting a correspondingly shaped inclined shoulder 16 of the container. The angle of the inclined portion should be greater than the critical angle at which the powder or granular material can rest under gravity on the shoulder, without falling to the base. The container also comprises a handle 18 and finger grips 17 for ease of insertion onto the dispenser. As mentioned above, the water jet 5 is fitted through the circular wall of the support.

Before a container is mounted on the dispenser, its head portion is covered by a removable cap, for example a snap-fastening cap. This cap covers the mesh 10 and the aperture 9. Before the container is used, the aperture 9 and the mesh 10 are also protected by a covering of water soluble paper, which is positioned preferably below the mesh to promote rapid dissolving of the paper without wetting of the detergent on initial start-up. When the cap is removed prior to the container being mounted on the dispenser, the paper prevents the powdered detergent from escaping from the container. However, as soon as water is injected into the container, the paper dissolves and the detergent is efficiently dispensed.

In the embodiment illustrated in FIG. 1, only one jet tube 5 is shown. While a single jet tube will work efficiently, if desired more than one tube could be arranged for inserting several jets of water around the base of the container. Alternatively, conduit means could be arranged around the base to funnel water from a single jet to be inserted through several apertures in the head portion of the container.

Figure 2:
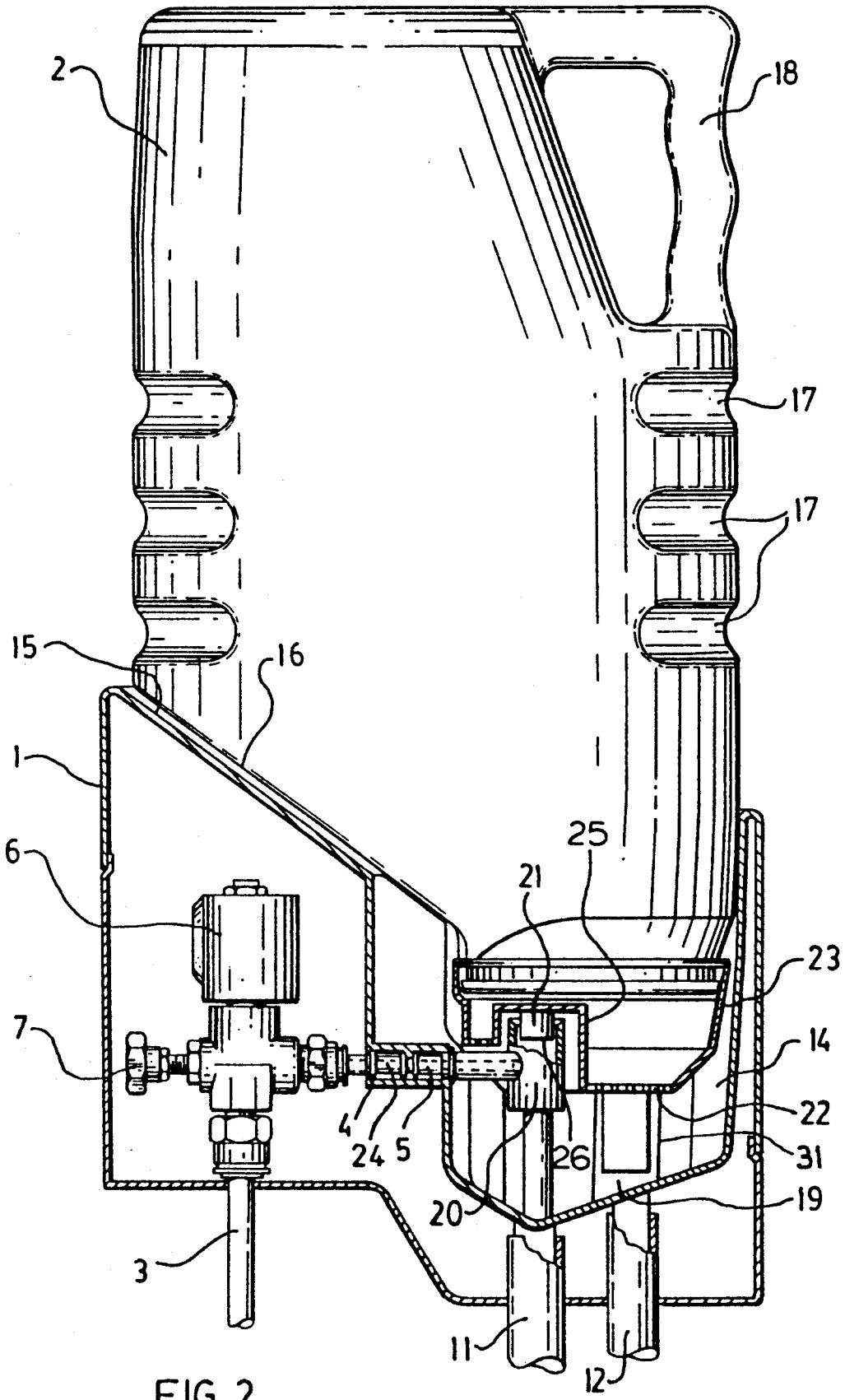
FIG. 2 is a view similar to FIG. 1 but showing a container for detergent in a solid, block form.
Figure 5A:
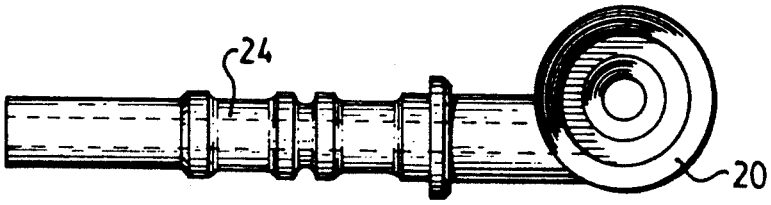
FIGS. 5*a* and 5*b* are top and side views of a detail of the dispenser of FIG. 2.
Figure 5B:
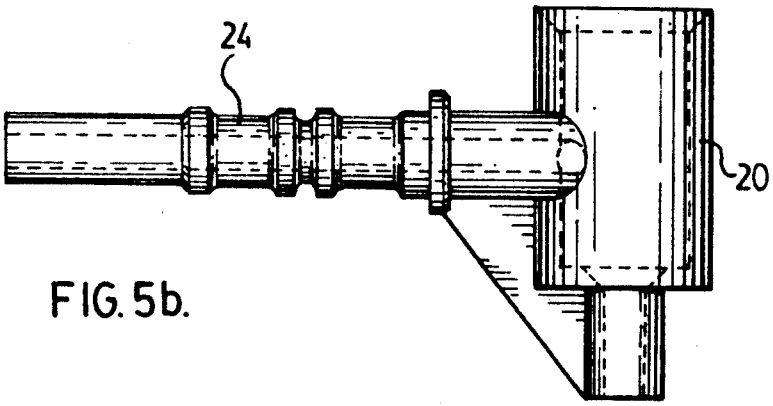

In the embodiment described above, it has been assumed that the container comprises detergent in a granular, powder or pellet form which will fall by gravity to the base of the container where the water is injected. However, in the embodiment of FIG. 2, it is assumed that the container comprises a detergent in a solid block form. In this embodiment, the dispenser itself is substantially the same as that in FIG. 1., except that an additional element has been added. This element, more clearly seen in FIG. 5, comprises a cup device 20 with an inlet pipe 24 fitted on the end of the jet tube 5. The pipe 24 connects tangentially with the cup 20 and so the water jet is directed in a circular manner around the cup. This head portion 23 of the container for the solid detergent has a recess 25 which accommodates the cup 20 and contains a nozzle device 21 which, when the container is mounted on the dispenser, fits tightly into the cup 20. The nozzle device is generally cylindrical and has a small aperture 26 in its base. The water injected into the cup 20 is forced out through this aperture and this results in a generally conical spray of water being injected upwardly into the container to wash down the solid detergent. The container again has the mesh 10 as in the previous embodiment with openings 22 formed therein.

When the container is removed, water simply bubbles over the edge of the cup 20, in a controlled and safe manner.

The control of the water jet by the adjusting screw 7 will now be discussed. Due to gravity, it is obvious that the jet of water will fall as it leaves the jet tube 5. The extent to which the jet falls is dependent upon the water pressure. It is desired that the jet of water always hits the same point on the deflector 13, what ever the water pressure. Accordingly, when a dispenser is first installed, the jet of water is aimed at a target on the deflector. By means of the adjusting screw 7, the jet of water is either raised or lowered.

It should also be explained that the water jet need not be perfectly horizontal for the advantages of the invention to be obtained. Provided that the injection of water has a significant radial component compared to its vertical component, the invention will operate. Of course, the radial component must be sufficient for the jet of water to travel from one side of the head portion of the container to the other, without simply falling through the mesh.

For example, if the internal diameter of the jet tube 5 in FIG. 1 is 3.5 mm, the distance from the end of the jet tube to the deflector 13 is 76 mm and the flow rate 1.3 liters/min., then it can be calculated that the jet tube 5 discharge will have to be inclined upwards at 2.3° in order that the water jet passes through the centre of the aperture 9 and impacts on the deflector 13 in the centre of its lower slope.

We claim:

1. A dispenser for receiving an dispensing granular detergent from a container, comprising:

(a) a support for supportably receiving an inverted container of granular detergent;

(b) a container for holding and dispensing granular detergent, having a head portion which is lowermost of said container as inverted and positioned in and extending vertically in said support, said head portion having an aperture formed therein which opens laterally of said head portion and extends transversely of said vertically extending container;

(c) means for injecting and directing a horizontal stream of water into said container to dissolve granular detergent in said head portion, said water injecting means extending through a portion of said support adjacent and spaced apart from said container head portion aperture, whereby said water injecting means directs a horizontal stream of water into said aperture; and (d) said container head portion having a bottom in which an outlet is provided, said outlet comprising a plurality of louvres traversing said outlet to define a mesh which substantially retains granular detergent in said container and which permits dissolved granular detergent to pass through said outlet;

wherein the support further comprises an overflow which is dimensioned such that the vertical distance between the water surface in the overflow and the water injection point is always at least 40 mm.

2. A dispenser for receiving and dispensing granular detergent from a container, comprising:

(a) a support for supportably receiving an inverted container of granular detergent;

(b) a container for holding and dispensing granular detergent, having a head portion which is lowermost of said container as inverted and positioned in and extending vertically in said support, said head portion having an aperture formed therein which opens laterally of said head portion and extends transversely of said vertically extending container;

(c) means for injecting and directing a horizontal stream of water into said container to dissolve granular detergent in said head portion, said water injecting means extending through a portion of said support adjacent and spaced apart from said container head portion aperture, said water injecting means being the sole source of water for dissolving said detergent, whereby said water injecting means directs a horizontal stream of water into said aperture; and (d) said container head portion having a foraminous bottom in which an outlet is provided, said outlet comprising a plurality of louvres traversing said outlet to define a mesh which substantially retains granular detergent in said container and which permits dissolved granular detergent and water to pass downwardly through said outlet.

* * * * *